US005108495A

United States Patent [19]

Heimala et al.

[11] Patent Number: 5,108,495

[45] Date of Patent: Apr. 28, 1992

[54] METHOD CONTROLLING A PROCESS BY IMPEDANCE ANALYSIS

[75] Inventors: Seppo O. Heimala, Pori; Kaarlo M. J. Saari, Ulvila, both of Finland

[73] Assignee: Outokumpu Oy, Helsinki, Finland

[21] Appl. No.: 351,647

[22] Filed: Jun. 6, 1989

[30] Foreign Application Priority Data

May 13, 1988 [FI] Finland ..... 882261

[51] Int. Cl.[5] ..... C22B 3/04

[52] U.S. Cl. ..... 75/386; 423/26; 423/658.5; 423/DIG. 17; 209/3; 209/901; 209/902; 73/61 R

[58] Field of Search ..... 75/375, 386; 423/26, 423/658.5, DIG. 5, DIG. 17; 209/901, 902, 3; 73/61 R

[56] References Cited

U.S. PATENT DOCUMENTS

| | | | |
|---|---|---|---|
| 3,883,421 | 5/1975 | Cutting et al. | 204/153.1 |
| 4,011,072 | 3/1977 | Holman et al. | 423/26 |
| 4,253,063 | 2/1981 | Tweeton | 324/324 |
| 4,561,970 | 12/1985 | Heimala et al. | 209/166 |

OTHER PUBLICATIONS

Comprehensive Treatise of Electrochemistry, vol. 4: Electrochemical Materials Science—Israel Epelboin et al., 1981, pp. 160–167.

Study of the Adsorption of Xanthate on Galena by Measurements of the Interfacial Impedance, Influence of the Semiconducting Nature of the Mineral—Daniel Schuhmann, 1985, pp. C 3.1–C 3.13, Latin American Congress on Flotation.

*Primary Examiner*—Melvyn J. Andrews

*Attorney, Agent, or Firm*—Brooks, Haidt, Haffner & Delahunty

[57] ABSTRACT

The invention relates to a method for controlling a process operating by means of the electrochemical potential, in which process complex ores and/or concentrates are treated in order to arrange the valuable components in the materials in a form appropriate for further processing and in which method electrodes made of material essentially similar to the materials to be treated in the process. According to the invention an impedance analysis in connection with the measurement of the electrochemical potential is carried out for the material to be treated in process in order to analyze the state of the solid surface and/or the state between the solid material and the intermediary material. The measured values are utilized in the adjustment of the process parameters. In order to carry out the impedance analysis voltage pulses are conducted into the material in at least one frequency and in at least one value of the electrochemical potential of the material.

12 Claims, 5 Drawing Sheets

METHOD CONTROLLING A PROCESS BY IMPEDANCE ANALYSIS

Figure 1:
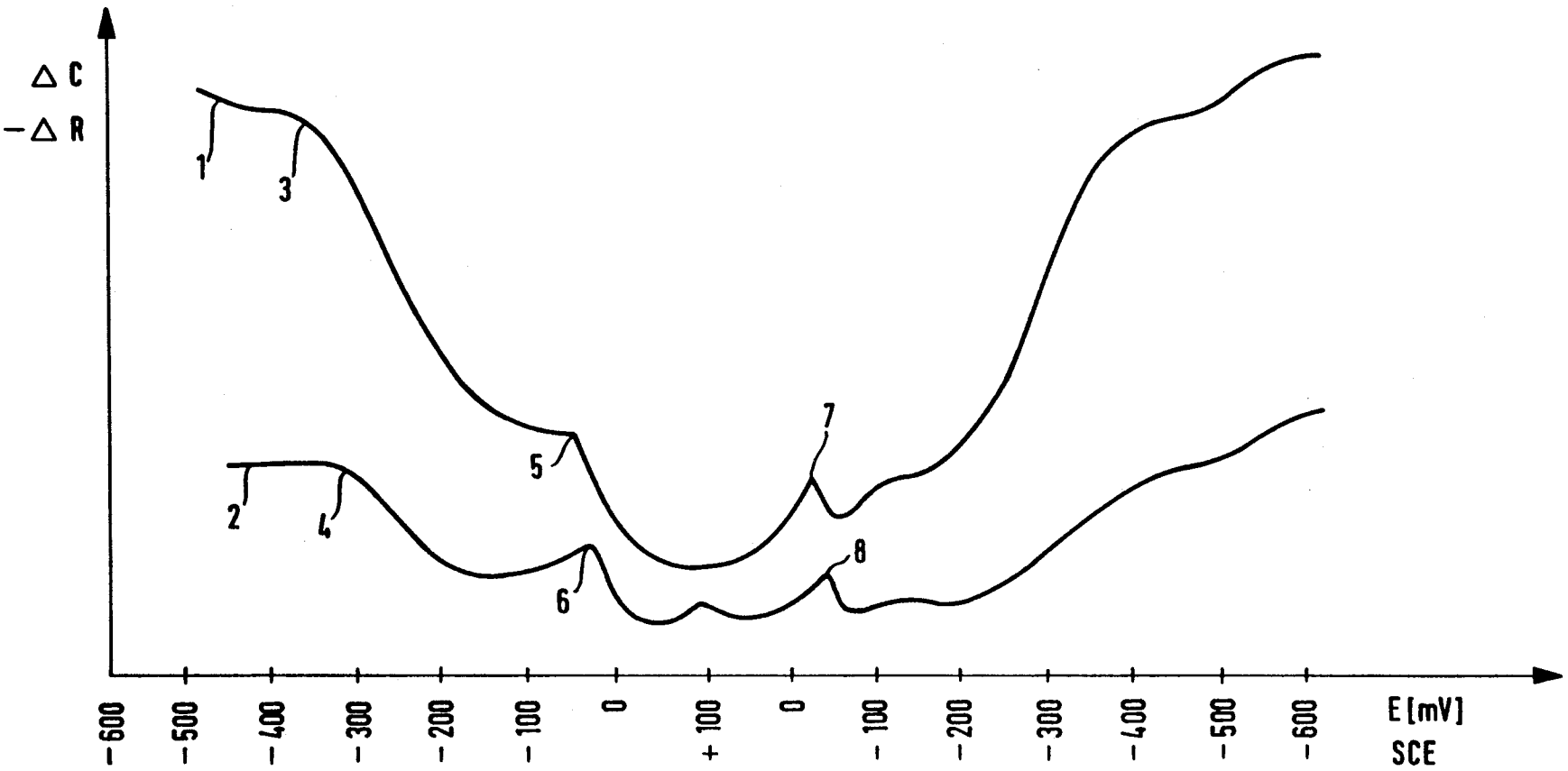

This invention relates to a method for controlling a process, in which process complex ores and/or concentrates are treated in order to achieve the valuable components contained in the material in a form appropriate for further processing. The invention relates particularly to a process possible to control by means of the oxidation/reduction reactions, as flotation, leaching and precipitation processes for different materials.

Traditionally, the oxidation/reduction processes are adjusted using a pH measurement, weighing and volume measurement. Often these kinds of methods are still nowadays used when treating simple materials. For the materials which are a little bit more difficult to treat it is known to use for example the method described in the U.S. Pat. No. 3,883,421 wherein the oxidation/reduction measurement and adjusting controlled by the inert electrodes, as platinum are used.

The second example of the preferable process control which operates in the simple processes, is a method wherein the concentrates of the elements in the slurries and solutions are measured by an x-ray method. In these methods, they trust in statistic quantities because only physical quantities are used for measurements and control in the control of chemical oxidation reduction processes. However, this does not give a sufficient basis in the treating of the complex materials.

The use of the inert electrodes in the measuring and adjusting methods of the solid materials described in the U.S. Pat. No. 3,883,421 above is generally not advantageous, because for example the oxidation/reduction processes for the minerals are mainly dependent on the electrochemical process of the mineral phase. This electrochemical potential, further, depends on the kinetics of both the cathodic (reduction) and the anodic (oxidation) reactions which are different from the separate minerals. Further, the minerals are changed because of the reactions.

Instead of inert electrodes, there have been developed methods for the measuring of oxidation/reduction processes, as flotation, precipitation, sulphidication, leaching as well as bacterial leaching in which methods active mineral electrodes are used for the controlling of the process simultaneously when the contents of determined soluable components are measured. These kinds of methods are described for example in the U.S. Pat. No. 4,561,970 and in the Canadian patent 1243349. In the measurements based on these methods there are been successful to follow physical and chemical developments to be done in the minerals and to influence them in the practical process.

In the above mentioned methods of the U.S. Pat. No. 4,561,970 and the Canadian patent 1243349 for the control it is used many mineral electrodes corresponding to the minerals of their owns in the processes in separate process stages. By means of these electrodes using ultra sound and anodic and/or cathodic pulses having different shapes for the adjusting of the electrode condition there are measured potentials of different minerals and contents of soluble components as well as contents of slurries on the surface of the solid material. The components to be measured are for example sulphides, water-soluble or non-water-soluble collectors, possible cyanides, polythionates and the elements copper, lead, cobalt, nickel, zinc, arsenic, antimony and oxygen. In the methods corresponding to the above mentioned processes where electrodes made of mineral are used, the shape of the mineral electrode can be for example wire, sheet, bar, rod or even powder and it can be rotatable or vibrative.

The optimal conditions in the leaching and for example in the simultaneous flotation of many minerals can be variable essentially when speaking of the electrochemical potential, though the mineral or the minerals are kept as the same but the contents of minor elements are changed. Generally, these contents of minor elements are below 1% by weight and then they are not traced in the continuous action analyses of the process analyzers for slurries. In the same way, the optimal conditions are changed in accordance with the particle size and the crystal shape. These changes create need for changes also in the process control, as in the contents and quality of leaching and flotation reagents and the pH value as well as in the degree of the acidity and the oxidization of the slag.

The object of the present invention is to eliminate the drawbacks of the prior art and to achieve a preferable method for the control of a process for treating complex ores and/or concentrates wherein using active mineral electrodes as well as analyzing the state of the solid surface and/or the state between the solid material and the intermediate material there can be recognized the qualities and the contents of the compounds having different types and to control the process on the ground of the so determined values.

Traditionally, it has been impossible to determine directly from a slurry molecules or ions which are often long-chained, slightly soluble and often very surface-active and which essentially are influencable to oxidation/reduction or other corresponding processes, as sulphur complexes in different compounds, humic acids and ions and gels containing silicon oxide. In accordance with the invention using an impedance analysis method together with the potential measurements carried out for the minerals there can be recognized essentially precisely the qualities and the contents having different types. For this recognizing in accordance with the invention one or more minerals are needed depending on the applied system.

According to the invention for the application of the impedance analysis there are conducted to the mineral potential or current pulses using at least one frequency and at least one potential value of the mineral in order to determine the ratio of the capacitance/inductance and the resistance value between surface of the mineral and the intermediary material advantageously with the ultra sound as well as carrying out the regeneration of the mineral electrode using for example the way described in the Canadian patent 1243349. Comparing the measured values with each other it can mineral by mineral be determined for example the influenced length of the chain of polysulphide-polythionate ions as well as the effiency of humic acids, silicon oxide complexes and gels in the process under the treatment. On the basis of the measured information there can automatically be chosen for example a new pH value for the process. Further, the information measured by the impedance analysis in the leaching and flotation process means when speaking about the sulphur compounds for example to achieve as a great leaching velocity as possible for the given minerals, while the others, as pyrite $FeS_2$ or $NiS_2$ can be passivated or precipitated simultaneously. In addition, in the flotation process it is possible to choose the covering effect created by the sulphur or the sulphur compound on each mineral using as a reagent for example sulphides, sulphur dioxide or sulphites. As a result from these stages there is achieved a selective flotation, leaching or precipitation in an economically advantageous way, also as a combined process; with small costs of reagents but with great efficiency. Also the use of sulphur as a collector is managed more often than before and essentially in a restrained manner.

According to the invention using impedance analysis with the mineral electrodes in the processes based on the oxidation/reduction processes, as in the flotation process there can be adjusted the amount of the frothing agent advantageous, as well as the influence of the finely ground materials in the oxidation/reduction processes.

As to the influence of the minor elements, their influence for moving the optimal conditions has been proved to be in the potential measurements usually over 30 mV, while the economical optimalisation of the process requires the precision of a few millivolts. According to the invention the adjusting need caused by minor elements is realized in the process practice by connecting the continuous-action x-ray analysis which operates element by element and/or mineral by mineral to the other operations based on the invention as to the potential measurements and to the impedance analyses done by the desired way. These kinds of factors connecting to the minor elements and impurities in the ores and in the corresponding minerals are among others the reactions caused by means of a catalysis and the reactions concerning to the ion exchange of the minerals and the reactions otherwise occurring in which reactions it is advantageous to use the feed-forward (e.g. potential) and the feed-back (e.g. the x-ray analysis for products) adjustment joined to the impedance analysis in accordance with the invention. As practical examples of these are among others the flotation of the salt-type minerals, as apatite where it is often advantageously controlled by the method either to maintain or to change the given ion composition to the given mineral. The ions suitable for the ion exchange are all the ions which for example in the flotation process form in the mineral to be recovered essentially strong links with the collector. Also the control and the adjustment of the factors connecting to the electrolysis and to the quality and the purity of the electrolyte in connection to the electrolyses of zinc, copper, nickel, cobalt, chromium, manganese and gold it is advantageous to carry out by the way according to the invention.

The method according to the invention can advantageously be used for the measurements of the contents of the inert, non-ionized collectors. Then a mineral electrode operating in the slurry conditions freely or controlled by an electric device, as a voltammeter, is used on the determined potential level. The impedance analysis according to the invention can thus be carried out by at least one electrode determined in different potentials, however, advantageously using two frequencies. This particularly concerns the flotation of finely-ground minerals where the selective flocculation of minerals is exploited using the impedance analysis, the potential measurement, measurements of contents by the voltammeter as well as mineral and elemental analyses done by x-ray devices mineral by mineral in accordance with the invention.

The method according to the invention can in addition to flotation, leaching and precipitation processes be applied for example for the elimination of nitrogen and sulphur compounds from gases and for the leaching of precious metals from clumsy materials as well as for the mutual separation of materials containing arsenic, antimony, selenium, tellurium and phosphorus having properties close to each other. Further, the method according to the invention can be applied for the analysis analyzation and the adjustment of the oxidation/reduction and ion exchange processes occurring in organic phases, salt melts and slags. The above mentioned leaching processes of precious metals are essentially those where some complex of sulphur, as thiosulphates thiourea or thiosulphates and polythionates is used. In these processes, the chemistry of sulphur and thus the leaching process is difficult to control and to keep in an economically effective area without the method using the impedance analysis in accordance with the invention. The invention can also be applied in combination with the use of spectrometric methods, as the spectroscopy of the ultra violet and the infra red radiations and the Raman effect in slurry materials.

Figure 2:
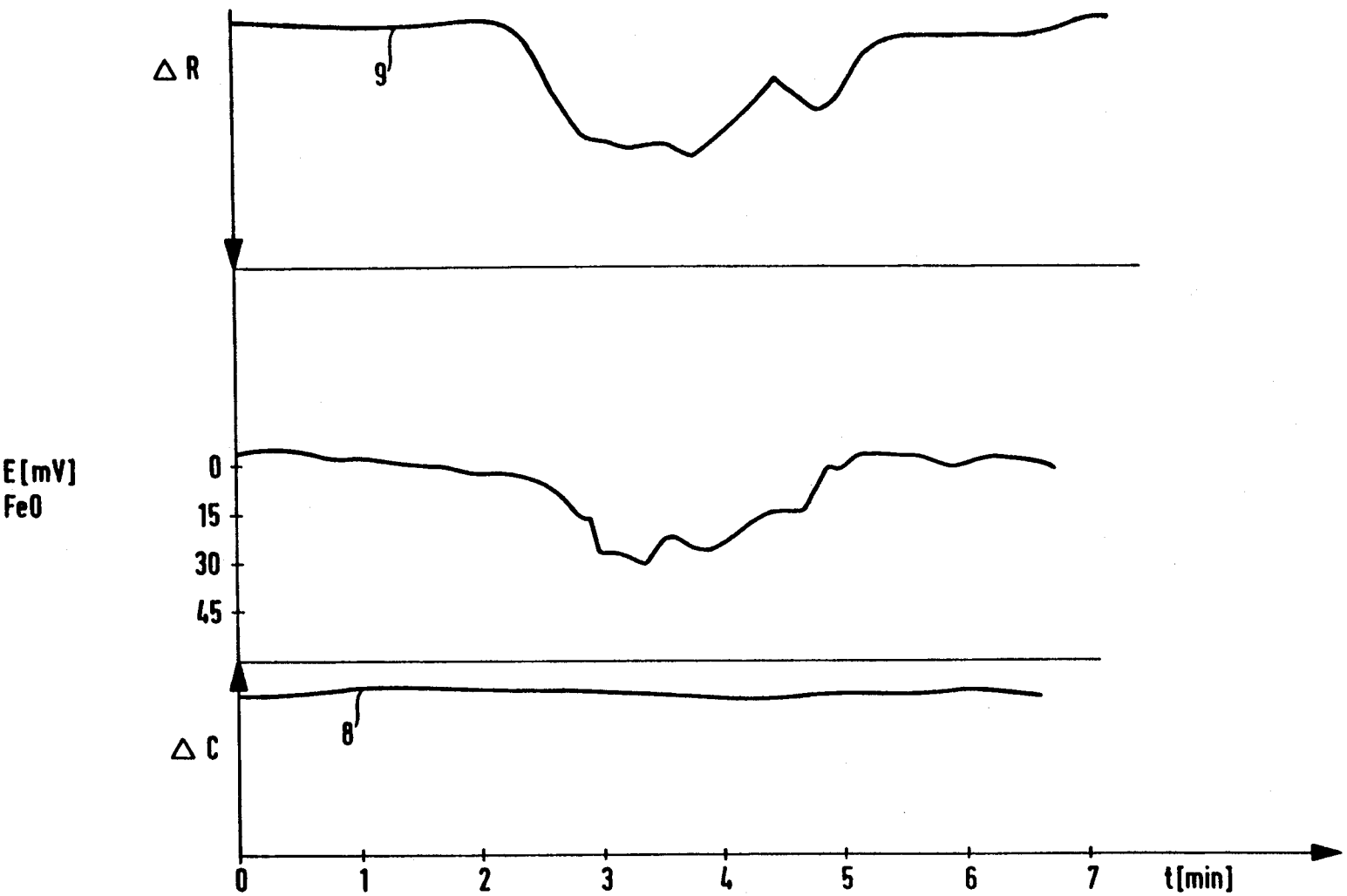
Figure 3:
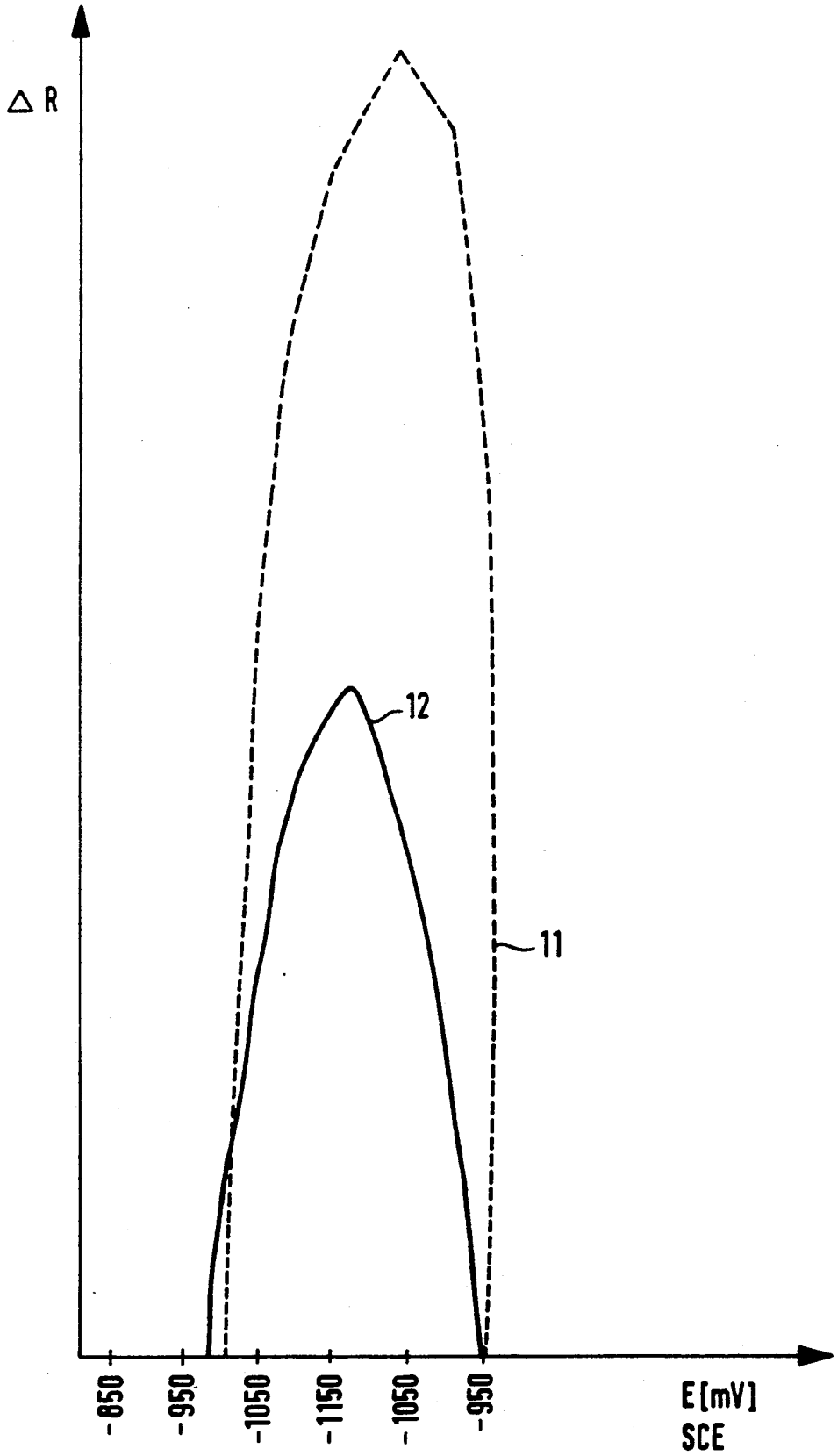
Figure 4:
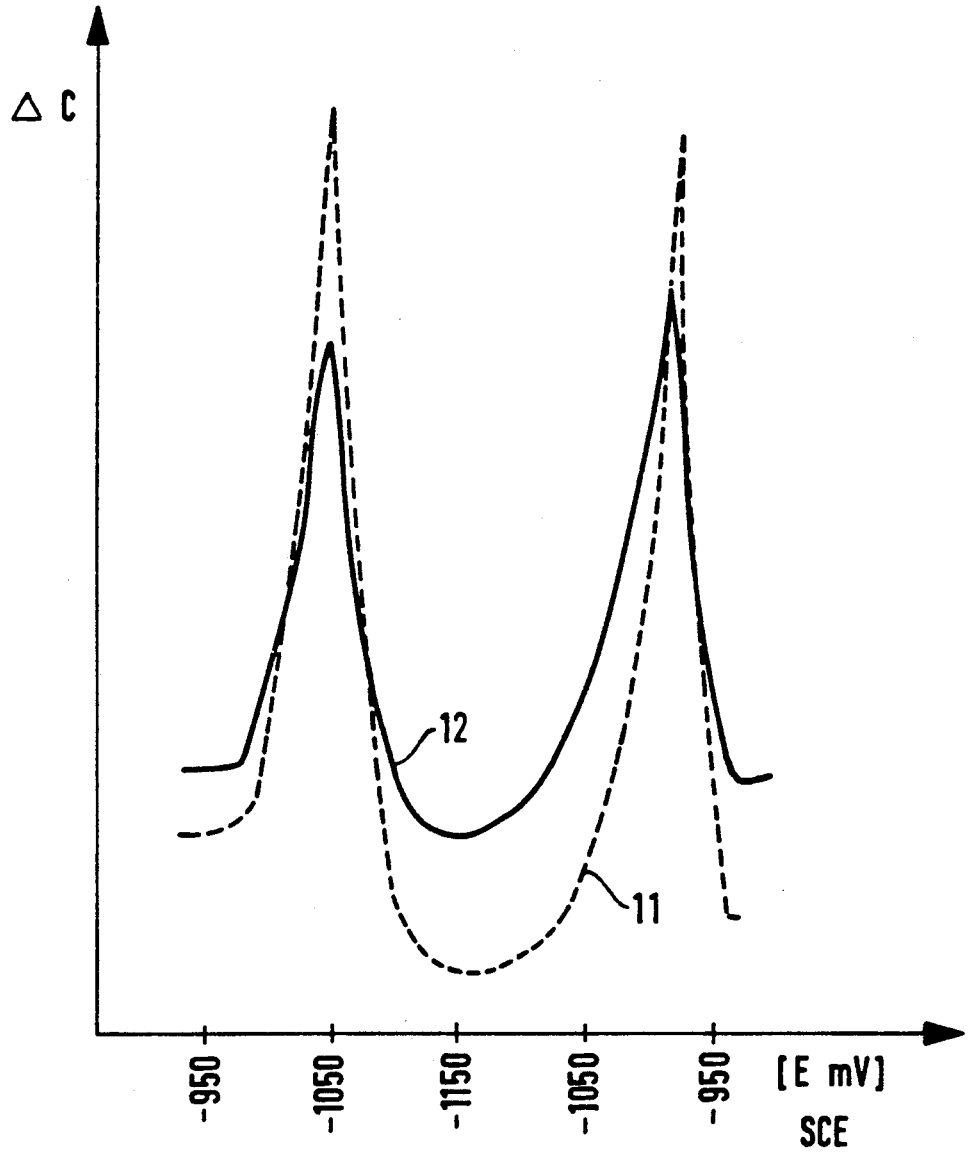
Figure 5:
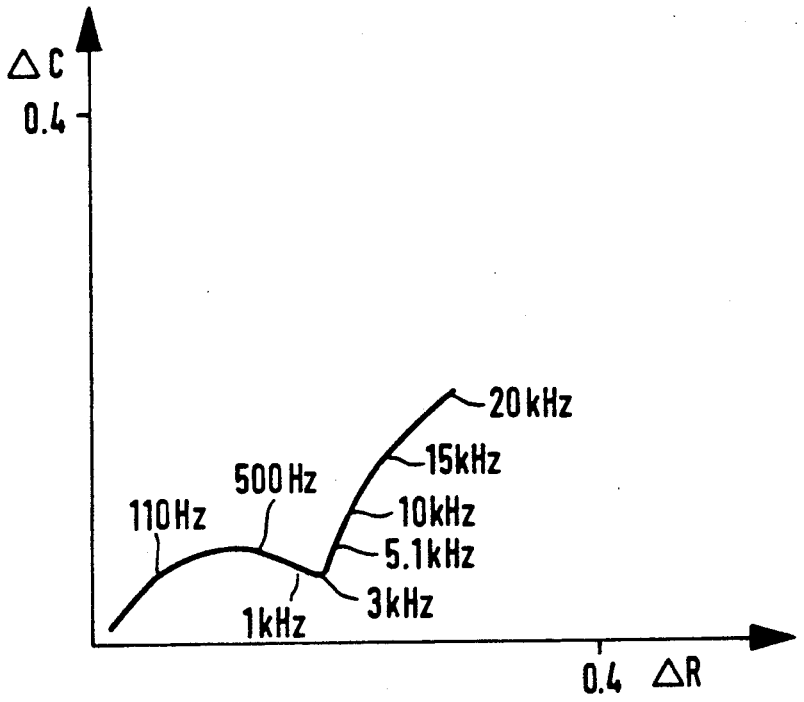
Figure 6:
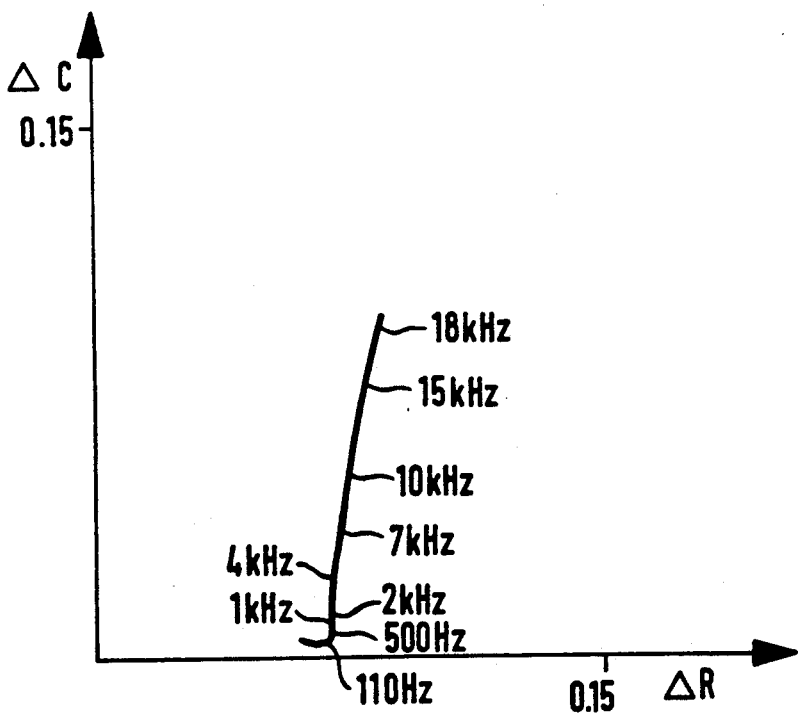

The invention is described more detailed in following referring to the accompanying drawings, wherein FIG. 1 depicts the embodiment of the invention to the measurements of contents of collectors in a flotation process, FIG. 2 depicts the embodiment of the invention to the measurement of an oxidation/reduction process in the condition of a high temperature electrolyte, FIGS. 3 and 4 depict the embodiment of the invention to the determination of the quality of a zinc electrolyte, FIGS. 5 and 6 depict the embodiment of the invention to the determination of polymers created in a leaching-precipitation process and using different values of frequency.

FIG. 1 depicts the reaction of a collector used in the flotation process with an electrode having a type of $Cu_{1,96}S$, when the potential of the electrode has been changed from the potential value of −600 mV SCE to the value of +100 mV SCE and further back to the value of −600 mV SCE. The changes depicted in FIG. 1 and measured in the frequency of 130 Hz for the capacitance (ΔC) (curve 1) and for the resistance (ΔR) (curve 2) are thus depicting the impedance changes concerning the collector and the material to be flotated. On the basis of FIG. 1 it can be mentioned that at the points 3 and 4 when the capacitance is decreasing and the resistance is increasing the collector sticks to the surface of the material to be flotated. In the points 5 and 6 the collector $EX^-$ in the ion form comes to the layer surface where there occur the reactions $$EX^- \rightarrow (EX)_2 \quad (1)$$

and $$S^{2-} \rightarrow S^0 \quad (2).$$

Similarly, the reactions 1 and 2 occur in to the other directions in the points 7 and 8 when the potential is changed back. In FIG. 1 one can see that the appropriate flotation potentials for the mineral of $Cu_{1,96}S$ are between −180−−140 mV SCE and −50−−0 mV SCE.

In FIG. 2 the method according to the invention is applied in the conditions of a high temperature electrolyte for the measurement of an oxidation/reduction process. As an electrolyte is an ion melt based on $FeSiO_4$ from the flash smelting furnace of the copper smelting at the temperature of 1300° C. and the atmosphere based on $SO_2$. The melt analysis was (% by weight): Cu 2,52; S 0,27; Fe 40,3; Zn 2,74; Pb 0,56; Ni 0,04; As 0,30; $SiO_2$ 31,5; MgO 1,70; $Al_2O_3$ 4,7; CaO 5,9. In the measurements oxide electrodes, have been used for example $(Fe,Me_{1-n})_3O_4$, and the capacitance (curve 8) and the resistance (curve 9) values are determined at a frequency of 130 Hz.

In the case according to the drawing the process has been changed slightly on both sides of the optimal conditions by feeding small amounts of a Cu concentrate (1-5% of the amount of the slag).

When working so by measuring the oxidation ratio of the slag, as well as the changes of the capacitance and the resistance between the electrode and the slag in order to carry out the impedance analysis in accordance with the invention the oxidizing ratio of the slag can be adjusted suitably for the copper production by adjusting on the basis of the measurements among others the amounts of the feeding material and air/oxygen. Just analogically for example in steel manufacturing the process can be carried out using spinel electrodes of $MgO.Cr_2O_3$ or $MgO.(Al,Cr)_2O_3$.

The method according to the invention can also be applied for example for the determination of the quality or the purity for different electrolytes. In FIGS. 3 and 4 there is depicted at the frequency of 330 Hz the curves for the changes of the resistance (ΔR) and the capacitance (ΔC) in the impedance analysis of a pure (curve 11) and a non-pure (curve 12) zinc electrolyte. It can be seen in FIG. 3 that the resistance value (potential −1150 mV) for the increase of zinc in the non-pure electrolyte is essentially different from the one in the pure solution. Similarly, according to FIG. 4 the capacitance value for the pure solution is essentially smaller when comparing with a non-pure solution. Similarly, at the leaching area of zinc (potential −950 mV) the capacitance of a pure solution is essentially greater when compared with a non-pure zinc electrolyte. When using impedance analysis according to the method of the invention it is possible to determine the portion of a non-pure and a pure zinc electrolyte and to make better the electric recovery of the process from the value of 89,3% for a non-pure solution to the value of 94,7% for a pure solution.

At FIG. 5 there is depicted the performing of the impedance analysis for a polythiosulphate polymer $S_4O_6^{2-}$ by changing the frequency between 10 Hz-20 kHz. The measurement is carried out with a $Cu_2S$ electrode in the potential value of −52 mV SCE from the solution for which the pH was 8,2 and which included 7,42 g/l hydrated copper sulphate $CuSO_4.5H_2O$ and 22,0 g/l sodium thiosulphate $Na_2S_2O_3$. It is seen from FIG. 5 that when the polythiosulphate polymer $S_4O_6^{2-}$ is present the capacitance and the resistance are changing essentially when the frequency increases over 3 kHz.

In the determination for the influence of the frequency for the polythiosulphate polymer $S_8 6^2$ according to FIG. 6 the solution surrounded the $Cu_2S$ electrode for the impedance analysis included 11,1 g/l hydrated copper sulphate $2CuSO_4.5H_2O$ and 22 g/l hydrated sodium thiosulphate $4Na_2S_2O_3.5H_2O$. The pH of the solution and the potential used, on the contrary, were similar to the values of FIG. 5. Also in the embodiment of FIG. 6 the increasing of the frequency changes the capacitance and resistance values in the layer surface in a way which can be exploited when determining the quality and concentrate of a polythiosulphate polymer in the process conditions.

The application of the method in accordance with the invention for the treatment of different materials is described closer within the enclosed examples.

EXAMPLE 1

The hydrated nickel sulphide ore where the nickel content between the different part of the ore is varying between the high nickel content (>1% by weight) and the low nickel content (<0,6% by weight), was treated in the method of the invention. Because of the great variance in the nickel content the ore included different nickel compounds, as pentlandite and violarite where the nickel content was high, and for example chalcopyrite, cubanite and magnetite where the nickel content was low. In order to recover these different ore types for the ore to be fed to the process an x-ray diffraction analysis was first carried out by a continuous-action x-ray analyzer. On the basis of this analysis the chemical compounds present in the ore at any time made clear.

The ore to be treated which grinding fineness was 60% under 200 mesh, was conducted to the flotation. The electrochemical potential was measured by a pentlandite electrode. If the ore to be fed was in nickel content essentially close to a pentladite concentrate, one could use as the pH value in the range of pH=10,0-10,5. On the contrary, if the previous x-ray analysis showed in a time of 10-30 min that the ore content was essentially changing from a pentlandite, also the pentlandite electrode used in flotation process showed in the regard to the optimal situation negative potentials at their lowest −180--220 mV SCE which values the conditioning agent used in the flotation process was not able to increase. Now conducting according to the invention voltage pulses to the pentlandite electrode there could be carried out for the mineral an impedance analysis where the impedance spectrum of the pentlandite electrode was utilized. It could be seen from the impedance spectrum which consists of the impedance values measured in different potential values, that the resistance of the layer close to the surface of the pentlandite electrode increased 15-28% to the value measured for the pentlandite mineral.

Using the automatical control system connected to the flotation process the pH value of the flotation process was changed on the basis of the measured impedance values to the acidic area, pH=3,5-6,5 by feeding an acid. By means of these process changes the mineral potentials to be treated were adjusted suitably for the content level of the collector which for the pentlandite was −35-30 mV SCE. Further, when the diffraction analysis of the feeding material showed that the ore essentially included pentlandite, also the pH of the flotation process was changed back to the range of 10,0-10,5.

Using the method according to the invention the nickel recovery was in the flotation 76%, while using the method of the prior art the recovery was only 69%.

EXAMPLE 2

The method according to the invention was applied for the treatment a phosphate ore. In the ore calcium phosphate was essentially divided into two parts whereof the one included a lot of impurities, as 1-6% Fe, 0,5-3% Mn and 2-4% $CaCO_3$, and the other part was essentially pure calcium apatite.

The ore was ground to the fineness of 40% under 100 μm and was conducted through the conditioning to the flotation. For controlling of the conditioning and the flotation there were two different types of apatite electrodes which compositions were 82% by weight apatite and 96% by weight apatite, and as an addition one calcite electrode, 98% by weight $CaCO_3$. As a collector there was used a Hoechst 2818 reagent, as a flotation agent Dowfroth 250 and as a depressing agent time to time water-glass.

Before the conditioning and the flotation an x-ray analysis was carried out for the ore to be treated in order to determine the calcium phosphate type predominant in the ore at any time. On the basis of the x-ray analysis for the adjusting of the flotation there was used in emphasis the electrode type the closest to the ore content. Without depending on the electrode each measured and adjusted the physico-chemical state of the surfaces of the minerals at the ore utilizing the impedance analysis by carrying out the measurements in the different frequencies, 0,2 kHz and 2,7 kHz.

On the basis of the values measured from the apatite and calcite electrodes the flotation of the apatite types in the ore was carried out so that the flotation of the calcite in the ore was prevented. When treating the apatite containing a lot of impurities the potential of the apatite was adjusted as well by feeding to the flotation process reducing agents, depressing agents and activation ions for the flotation. Further, in order to achieve on the basis of the impedance analysis of the calcite the capacitance and resistance values advantageous for the apatite flotation there was added in order to prevent the flotation of calcite water-glass used as a depressing agent.

When using the method according to the invention the recovery of $P_2O_5$ was 88,6% and the content of $P_2O_5$ in the concentrate 35,3% by weight. When using in accordance with the prior art the adjustment of pH and in constant amounts reagents counting per a weight unit the corresponding recovery of $P_2O_5$ was 83,9% and the $P_2O_5$ content in the concentrate 33,2%.

EXAMPLE 3

In order to recover valuable components from a sulphide ore based on pyrrhotite and having a low content of silicate which ore included 1,8% by weight copper, 2,6% by weight nickel, 0,7% by weight cobalt and 31% by weight iron, was treated in the method according to the invention by leaching in autoclave at the temperature of 140° C. using oxygen. Before feeding to the autoclave an x-ray analysis was carried out for the material which grinding fineness was 70% under 200 mesh, in a continuous-action analyzer in order to determine the relative portions of different compounds in the material. On the basis of the x-ray analysis depending on the pyrite quantity in the material at any time the material was slurried into the slurry density of 200–400 g/l solid material.

In order to control the autoclave leaching in the way according to the invention in the autoclave there were electrodes which represented as the materials essentially the compounds of $FeS_2$, $NiS_2$, CuS, $Cu_2S$ and $Fe_{1-x}S$. Further, in the autoclave there was a platinum electrode and as an additional electrode a solid electrolyte cell for the determination of pH in the solution. In the leaching process pH was varying between 1,5–4,0. As the reagents of the leaching process there were used oxygen and sulphur dioxide and time to time sulphur acid.

According to the invention by means of the impedance analysis, carrying out impedance measurements with different electrodes and in different potentials (for example with the $FeS_2$ electrode in the potential value of +40 mV SCE and +120 mV SCE and with the CuS electrode in the potential values of +20 mV SCE and +250 mV SCE) the capacitance and resistance values of different electrodes were compared with each other and the leaching process was adjusted by means of sulphur compounds so that on the surfaces of $Fe_{1-x}S$ and $FeS_2$ electrodes a layer of elemental sulphur was created, while on the surfaces of other electrodes it was not allowed to create a layer of elemental sulphur. Thus for example the potential of the $NiS_2$ electrode was in the range of +180–+230 mV SCE and the potential of the CuS electrode in the value of 220 mV SCE, while the potential of the $Fe_{1-x}S$ electrode was +80–+130 mV SCE and the potential of the $FeS_2$ electrode +190–+240 mV SCE.

After the autoclave, leaching of half an hour the recoveries for the solution were 89% copper, 97% nickel and 90,3% cobolt.

In order to realize the advantages of the method according to the invention there was carried out at the temperature an autoclave leaching where instead of the oxygen pressure controlled by the potentials and the impedance analysis a constant oxygen pressure of 10 bar was used. After this leaching time the recoveries were respectively: 43% copper, 74% nickel and 38% cobolt.

EXAMPLE 4

For the separation of copper minerals containing arsenic and antimony from essentially pure copper minerals a copper ore containing minerals from the series of chalcosite and covellite ($Cu_2S$, CuS) as well as chalcopyrite $CuFeS_2$, pyrite $FeS_2$, enargite $Cu_3AsS_4$, tennannite $(Cu,Fe)_{12}As_4S_{13}$, bornite $Cu_5FeS_4$, molybdenite $MoS_2$ was ground to the fineness of 65% under 37 μm. For the ground material to be fed to the process a continuous-action x-ray analysis was carried out in order to determinate the relative proportions of different compounds in the material. The material analyzed by x-ray was conducted after a long conditioning (0,5–1 h) to the flotation process where the pH value was maintained in the range of 9,0–11 using a controlled atmosphere in which atmosphere there was 15% air and the rest nitrogen. In the process pH was the higher, the more the x-ray analyzed feeding material included pyrite $FeS_2$.

For the control of the flotation process and for measuring of the surface structure of minerals as well as to the adjustment according to the invention there were used electrodes which were made of compounds of chalcosite, covellite, pyrite, molybdenite and tennantite. By means of the measurements of the impedance analysis and the respective adjustment using further the adjustment of the contents of the collector (dithiophosphate) and the flotation agent there were controlled by means of the potentials and the sulphur compounds ($NaHS,SO_2$) the flotation process so that the collector stuck to enargite and tennantite ($E_{SCE}$-50 mV), but not to other copper minerals.

Thus by means of the process according to the invention it was recovered an arsenic concentrate containing 5,2% by weight arsenic when the recovery of arsenic was 65%. In the residue the copper recovery was simultaneously 89,5% and the content of arsenic 0,4% by weight. In the method in accordance with the prior art using a constant pH value of 10,3 for the representative material there was created an arsenic concentrate containing 1,6% by weight arsenic in an arsenic recovery of 53%.

We claim:

1. A method for controlling the electrochemical potential in an oxidation/reduction process for treating complex ore and/or concentrate material to arrange valuable components in the material into a form appropriate for further processing to recover the valuable components comprising using electrodes made of a material similar to the material being treated and carrying out with such electrodes an impedance analysis by creating an impedance spectrum consisting of impedance values measured at different electrochemical potential values to determine a relationship between the state of the surface of the material being treated and the state of an intermediary material and adjusting process parameters according to said determination.

2. Method according to claim 1, characterized in that in order to carry out the impedance analysis into the material voltage pulses are conducted in at least one frequency and in at least one value of the electrochemical potential of the material.

3. Method according to claim 1, characterized in that in order to carry out the impedance analysis into the material current pulses are conducted in at least one frequency and in at least one value of the electrochemical potential of the material.

4. Method according to claim 1, characterized in that different electrode potentials are utilized for the impedance analyses of different phases in the material.

5. Method according to any of claims 1 or 2–4, characterized in that the impedance analysis is used for adjusting the electrochemical potential.

6. Method according to any of 1 or 2–4, characterized in that the impedance analysis is used for adjusting pH value.

7. Method according to any of claims 1 or 2–4 wherein reagents are fed into the process, characterized in that the impedance analysis is used for adjusting of reagents to be fed in the process.

8. Method according to any of 1 or 2–4, characterized in that the impedance analysis is used for the selective flocculation in order to separate the finely-ground materials from each other.

9. Method according to any of 1 or 2–4, characterized in that the impedance analysis is used for adjusting of flotation.

10. Method according to any of 1 or 2–4, characterized in that the impedance analysis is used for adjusting of precipitation.

11. Method according to any of 1 or 2–4, characterized in that the impedance analysis is used for adjusting of leaching.

12. A method for controlling an oxidation/reduction process for the recovery of valuable metal from complex ore or concentrate material, comprising grinding the material, conducting a preliminary analysis of the material to detect the presence of any minor elements or impurities in the material for adjustment of process conditions accordingly, mixing the material with an intermediate material, performing an impedance analysis by creating an impedance spectrum consisting of impedance values measured at different electrochemical potential values to determine the relation between the surface of the material being treated and the intermediate material and adjusting parameters of the treatment process in accordance with results of said impedance analysis.

* * * * *